US008353106B2

(12) United States Patent
Lasser et al.

(10) Patent No.: US 8,353,106 B2
(45) Date of Patent: Jan. 15, 2013

(54) WHEEL/RIM FIXING DEVICE AND METHOD OF USING THE SAME

(75) Inventors: Herbert Lauer Lasser, Chesterton, IN (US); Kickey Steven Lutterbach, Long Beach, IN (US); Adam M. Sworden, Lisle, IL (US); Joel P. Sanchez, Hobart, IN (US); Cesar P. Sanchez, Hobart, IN (US)

(73) Assignee: Rimsmith Tool, LLC, Chesterton, IN (US)

( * ) Notice: Subject to any disclaimer, the term of this patent is extended or adjusted under 35 U.S.C. 154(b) by 377 days.

(21) Appl. No.: 12/830,550

(22) Filed: Jul. 6, 2010

(65) Prior Publication Data

US 2011/0000087 A1 Jan. 6, 2011

Related U.S. Application Data

(60) Provisional application No. 61/270,138, filed on Jul. 6, 2009.

(51) Int. Cl.
*B21K 1/38* (2006.01)
*B21D 41/02* (2006.01)

(52) U.S. Cl. ..... 29/894.353; 29/894.35; 72/316; 72/392

(58) Field of Classification Search ..... 29/894.353, 29/894.35, 270; 72/80, 392, 316; *B21B 13/00; B21K 1/38*

See application file for complete search history.

(56) References Cited

U.S. PATENT DOCUMENTS

| | | | | | |
|---|---|---|---|---|---|
| 1,813,012 | A | * | 7/1931 | Asher | 72/125 |
| 1,916,476 | A | * | 7/1933 | Harbaugh et al. | 254/100 |
| 2,165,504 | A | * | 7/1939 | Pfauser | 72/392 |
| 2,200,133 | A | * | 5/1940 | Mandl | 72/54 |
| 2,395,469 | A | * | 2/1946 | Emrich | 72/392 |
| 2,718,253 | A | * | 9/1955 | Zinke | 72/392 |
| 2,764,215 | A | * | 9/1956 | Adams et al. | 72/392 |
| 2,903,928 | A | * | 9/1959 | Dobson et al. | 72/373 |
| 3,706,120 | A | * | 12/1972 | Bulgrin | 29/894.353 |
| 3,729,795 | A | * | 5/1973 | Roper | 29/894.323 |
| 4,285,136 | A | * | 8/1981 | Ragan | 33/203.18 |
| 4,646,434 | A | * | 3/1987 | Daudi | 29/802 |
| 4,985,993 | A | * | 1/1991 | Yagi et al. | 29/894.353 |
| 5,431,039 | A | * | 7/1995 | Goodman et al. | 72/447 |
| 5,499,524 | A | * | 3/1996 | Len | 72/420 |
| 5,634,361 | A | * | 6/1997 | Herschman et al. | 72/31.02 |

(Continued)

FOREIGN PATENT DOCUMENTS

WO WO 9308940 A1 * 5/1993

*Primary Examiner* — Joseph J Hail
*Assistant Examiner* — Marc Carlson
(74) *Attorney, Agent, or Firm* — Justin Lampel

(57) ABSTRACT

A device and method for fixing or repairing a wheel or rim of an automobile, truck, motorcycle or other vehicle is provided. The device has an adjustable shaft having a first side and a second side. The first side may act as a brace secured against the interior of a rim of, for example, an automobile. The second side may be the work end of the device which may be formed to fit the interior wall(s) of the rim. When the rim is heated and the shaft is extended, the device may allow a user to fix a dented rim. A bracing bar may be extended perpendicularly from the shaft and may act to secure the device in place while the work is performed.

8 Claims, 11 Drawing Sheets

U.S. PATENT DOCUMENTS 5,870,814 A * 2/1999 Herron ..... 29/402.08
5,946,965 A * 9/1999 Leone ..... 72/392
6,367,303 B1 * 4/2002 Hizono ..... 72/316
6,757,976 B2 * 7/2004 Baek ..... 29/894.322
7,415,766 B2 * 8/2008 Luschei et al. ..... 29/894.3
7,921,687 B2 * 4/2011 Stretch ..... 72/31.02
2004/0035164 A1 * 2/2004 Blaser, Jr. ..... 72/31.02
2004/0216294 A1 * 11/2004 Merrifield ..... 29/402.01
2006/0196244 A1 * 9/2006 Neubauer ..... 72/705
2007/0240296 A1 * 10/2007 Kliskey ..... 29/229
2008/0257002 A1 * 10/2008 Len ..... 72/31.02
2011/0107599 A1 * 5/2011 Tanaka ..... 29/894.322
2011/0241413 A1 * 10/2011 Uchida et al. ..... 301/63.101
2012/0047706 A1 * 3/2012 Neiburger et al. ..... 29/428

* cited by examiner

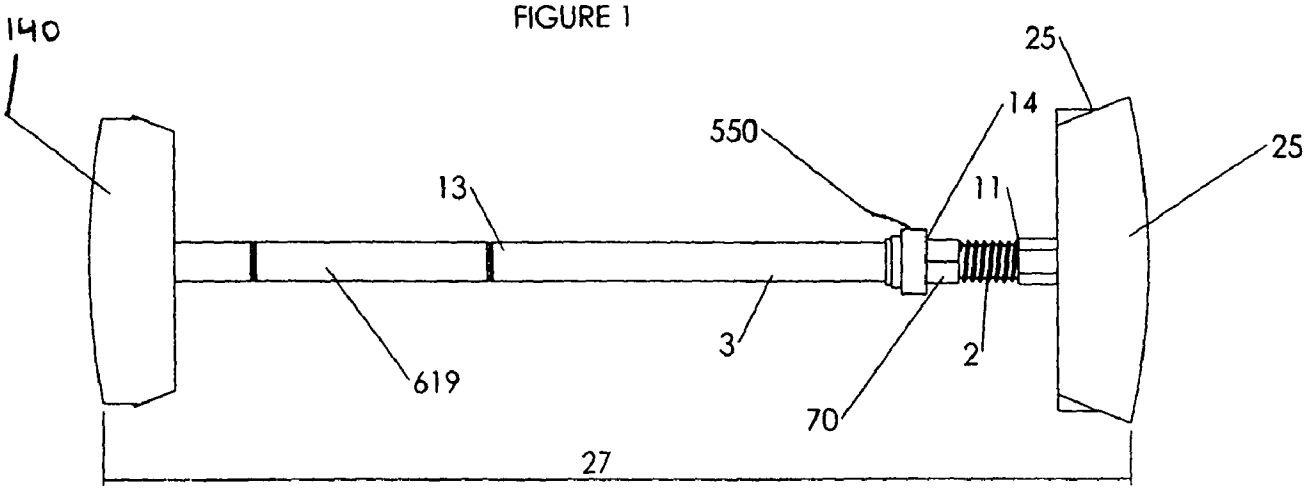
FIGURE 1
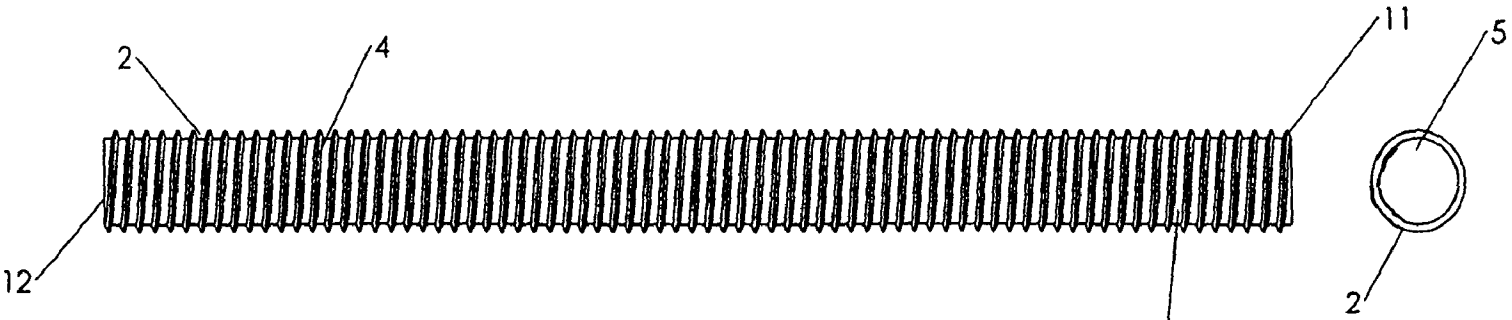
FIGURE 2A
FIGURE 2

WHEEL/RIM FIXING DEVICE AND METHOD OF USING THE SAME

CROSS-REFERENCE TO RELATED APPLICATIONS

This application claims the benefit of U.S. Provisional Application Ser. No. 61/270,138 filed Jul. 6, 2009 the same being incorporated herein by reference.

BACKGROUND OF THE INVENTION

A device and method for fixing or repairing a wheel or rim of an automobile, truck, motorcycle or other vehicle is provided. The device has an adjustable shaft having a first side and a second side. The first side may act as a brace secured against the interior of a rim of, for example, an automobile. The second side may be the work end of the device which may be formed to fit the interior wall(s) of the rim. When the rim is heated and the shaft is extended, the device may allow a user to fix a dented rim. A bracing bar may be extended perpendicularly from the shaft and may act to secure the device in place while the work is performed.

It is known to use devices to fix metal, including the rims or wheels on an automobile. For example, U.S. Pat. No. 7,334,449 to Neubauer discloses a method and apparatus for straightening dents and irregularities in wheels including a spindle, a platen mounted on the spindle configured such that the wheel can be mounted on the spindle with the spindle projecting through the central hub hole and at least one actuator device positionable between the spindle and a section of the wheel to be straightened, the actuator exerting a straightening force on the rim of the wheel and a mobile device including the same.

Further, U.S. Pat. No. 6,367,303 to Hizono discloses a method for readily performing repair work for a deformed portion of a rim without any adverse effects given by a rim shape of a wheel or a kind of the wheel, and to enhance the precision of the repairing work and the simplification of the apparatus by devising a receiver for a reactive force of a pressing jack, a wheel repairing apparatus includes a base on which the wheel H is to be mounted with its axis vertical, a support frame provided on the base, supporting means provided between the support frame and the base for rotatably supporting the wheel about the vertical axis and pressurizing means for pressurizing the deformed portion of the rim. The pressurizing means includes a pressurizing lever having a free end swingably rotatable about a proximal end for pressurizing the free end to be brought into contact with the deformed portion of the rim from inside, and a jack for applying to the pressurizing lever a force in a direction in which the deformed portion is returned to the original form. A reactive force of the jack is received by the wheel supporting means.

Even further, U.S. Pat. No. 5,303,573 to Douglas discloses aluminum automobile wheels which are straightened by exerting gentle pressure on the wheel to urge the wheel back to its original shape. If the metal does not move under pressure, the wheel is heated, and pressure again exerted, the process continuing until the wheel becomes round. A C-shaped wheel mount carries a spindle which mounts a hub. The hub rigidly receives the wheel, and the hub is selectively rotatable, and the wheel mount is selectively rotatable about a horizontal axis. The wheel is gently brought back to shape without excess heat or excess working to damage the metal. A final metal spinning step relieves stresses in the metal and brings the wheel to final tolerances.

However these patents fail to disclose a device which allows a user to easily and efficiently fix a wheel or rim in the manner described below. More specifically, these devices do not disclose an apparatus or method whereby a user heats the wheel or rim, extends a novel shaft within the interior wall of the wheel or rim and secures the device with a perpendicular securing bar as described herein. Accordingly, a need exists for a new and improved device and method of use of the same for fixing a damaged wheel or rim of an automobile, truck, motorcycle or other vehicle.

SUMMARY OF THE INVENTION

A device and method for fixing or repairing a wheel or rim of an automobile, truck, motorcycle or other vehicle is provided. The device has an adjustable shaft having a first side and a second side. The first side may act as a brace secured against the interior of a rim of, for example, an automobile. The second side may be the work end of the device which may be formed to fit the interior wall(s) of the rim. When the rim is heated and the shaft is extended, the device may allow a user to fix a dented rim. A bracing bar may be extended perpendicularly from the shaft and may act to secure the device in place while the work is performed.

An advantage of the present apparatus and method of using the same is to provide a wheel/rim fixing device which is light weight.

And another advantage of the present apparatus and method of using the same is to provide a wheel/rim fixing device which has interchangeable parts which may be used on wheels/rims of varying size.

Still another advantage of the present apparatus and method of using the same is to provide a wheel/rim fixing device which is durable.

Yet another advantage of the present apparatus and method of using the same is to provide a wheel/rim fixing device which has a safety device to prohibit extended elongation.

A further advantage of the present apparatus and method of using the same is to provide a wheel/rim fixing device which has a securing bar for reducing movement of the device while work is conducted.

Yet another advantage of the present apparatus and method of using the same is to provide a wheel/rim fixing device which is safe to use.

And another advantage of the present apparatus and method of using the same is to provide a wheel/rim fixing device which has a ball bearing containing ring which allows pressurized rotation.

BRIEF DESCRIPTION OF THE DRAWINGS

FIG. 1 illustrates a side plan view of the device for fixing a wheel or rim.

FIG. 2 illustrates a side plan view of the first shaft of the device.

FIG. 2*a* illustrates a cross section of the device in FIG. 2.

DETAILED DESCRIPTION OF THE PREFERRED EMBODIMENTS

Figure 4:
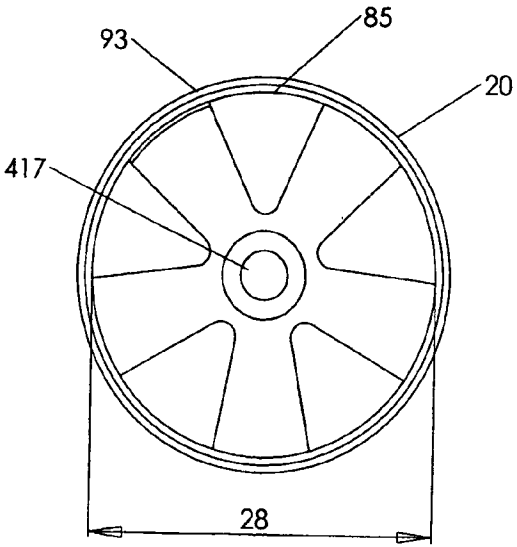
FIG. 4 illustrates a side view of a rim of a vehicle.

A device and method for fixing or repairing a wheel or rim of an automobile, truck, motorcycle or other vehicle is provided. The device has an adjustable shaft having a first side and a second side. The first side may act as a brace secured against the interior of a rim of, for example, an automobile. The second side may be the work end of the device which may be formed to fit the interior wall(s) of the rim. When the rim is heated and the shaft is extended, the device may allow a user to fix a dented rim. A bracing bar may be extended perpendicularly from the shaft and may act to secure the device in place while the work is performed.

The device 1 may have a first shaft 2 and a second shaft 3. The first shaft 2 and/or the second shaft 3 may be constructed from, for example, metal or any other suitable material. Preferably, the material should be strong and able to withstand high temperatures and pressures. The first shaft 2 may have an exterior 4 and an interior 5 (in some models, the first shaft 2 may be solid; thereby lacking an interior). The second shaft 3 may have an exterior 6 and an interior 7. The first shaft 2 may telescopically slide (via threads 10 of a screw) within the interior 6 of the second shaft 3. More specifically, the first shaft 2 may telescopically slide within the second shaft 3 by means of threads 10 and ridges 15, similar to that of a screw. While sliding in or out of the second shaft 3, the first shaft 2 may rotate with respect to the second shaft 3. As a result, the device 1 may be extended or contracted to reach a specified length suitable for the specific wheel or rim 20 for which the work is being performed on. The larger the wheel or rim 20, the more of the first shaft 2 is exposed.

The first shaft 2 may have a first end 11 and a second end 12. The second shaft 3 may also have a first end 13 and a second end 14. The second end 12 of the first shaft 2 may be inserted into the second end 14 of the second shaft 3. When inserted, the entire device 1 may have a length 27. The length 27 of the entire device 1 (including the removable head 25 and the non-working removable head 140 as described below) should be substantially similar to a length of a diameter 28 (FIG. 4) of the interior surface of the wheel or rim 20.

Figure 7:
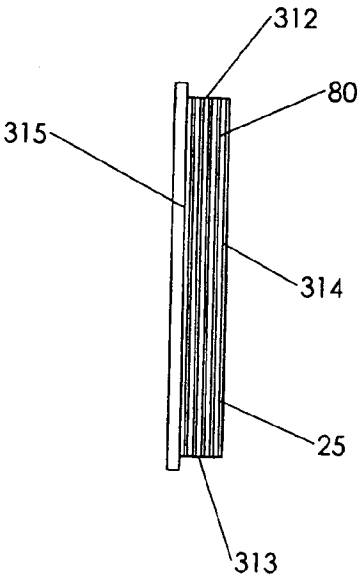
FIG. 7 illustrates a top plan view of the removable head of the device.
Figure 6:
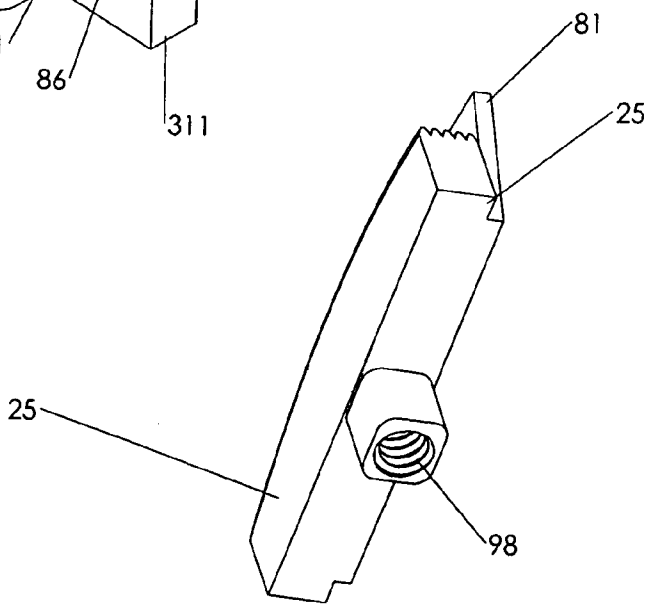
FIG. 6 illustrates a bottom perspective view of the removable head of the device.
Figure 5:
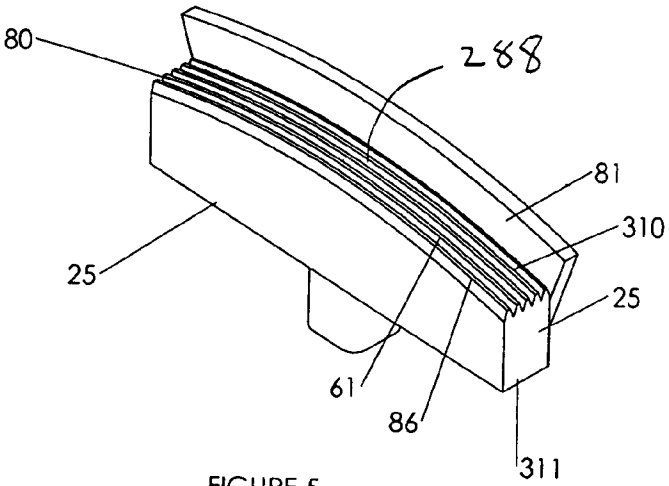
FIG. 5 illustrates a top perspective view of the removable head of the device.

Attached to the first end 11 of the first shaft 2 may be a removable head 25 (FIGS. 5-7). The removable head 25 may be secured to the first shaft 2 by, for example, threads 98 and grooves. The removable head 25 may be the working end of the device 1. The removable head 25 may have a working surface 80 and a guiding surface 81. In an embodiment, the working surface 80 may be curved and completely smooth so substantially contact the working surface of the wheel or rim 20. As a result, damage to the surface of the wheel or rim 20 may be largely eliminated. In an embodiment, the working surface 80 may not be smooth (as illustrated in FIG. 5).

The guiding surface 81 may be largely perpendicular to the working surface 80, and may curve with respect to the working surface 80. The working surface 80 may be curved to correspond to the curvature on the inside ridge 85 (FIG. 4) of the wheel or rim 20. The removable head 25 may be interchangeable so that the device 1 may be used on wheels or rims 20 of varying sizes. The larger the wheel or rim 20, the more gradual the curvature of the wheel or rim 20 and, therefore, the more gradual the curvature 86 of the working surface 80 and the guiding surface 81 of the removable head 25.

In use, the guiding surface 81 may be in contact with the outer rim surface 93 of the wheel or rim 20 and the working surface 80 may be in contact with an inside ridge 85 of the wheel or rim 20. As a result, the guiding surface 81 may act to stabilize the device 1 on the wheel or rim 20 so that work may be performed. In practice, the wheel or rim 20 is preferably removed from the vehicle and placed horizontally (with respect to the ground) on a secured mount, such as a tire changing machine.

A replaceable grip pad 288 (FIG. 5) may be added to the removable head 25 and/or the non-working removable head 140 (see below). The replaceable grip pad 228 may have a top 310, a bottom 311, a first side 312, a second side 313, a front 314 and a back 315. The bottom 311 of the replaceable grip pad 228 may be in contact with a top surface of the removable head 25 and/or the non-working removable head 140. The replaceable grip pad 228 may prevent the wheel or rim 20 from being scratched or otherwise damaged during the fixing process. Further, the replaceable grip pad 228 may add friction to the contact points of the device 1 and the wheel or rim 20 such that slipping of the device 1 is reduced during work. Finally, the removable head 25 may have a rigid surface to further grip the wheel or rim 20. More specifically, the removable head 25 may have, for example, metal teeth 61 which may act to create friction and grasp the wheel or rim 20.

Figure 8:
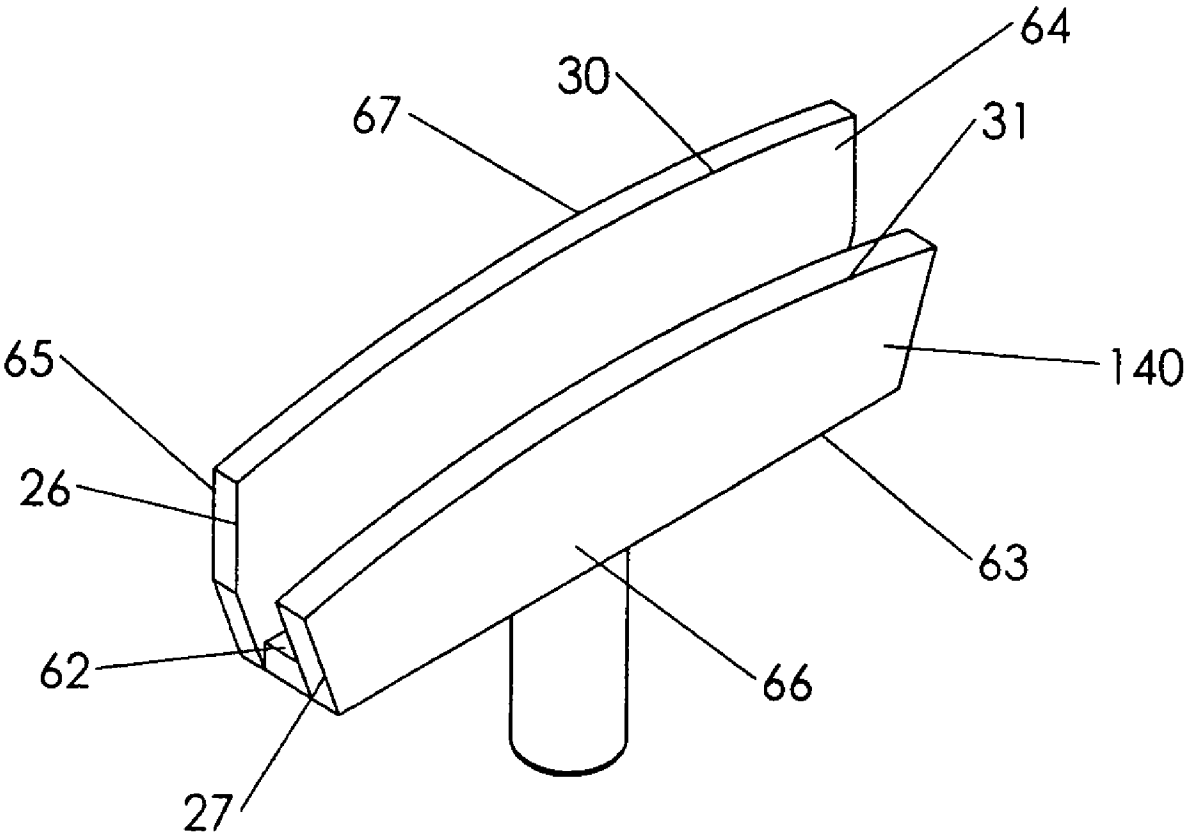
FIG. 8 illustrates a side perspective view of the non-working removable head of the device.

Attached to the first end 13 of the second shaft 3 may be a non-working removable head 140 (FIG. 8). FIG. 1 illustrates an extension device 619 located between the first end 13 of the second shaft 3 and the non-working removable head 140. The extension 619 may be removed for smaller wheels or rims 20. The non-working removable head 140 may have a top end 62, a bottom end 63, a first side 64, a second side 65, a front 66 and a back 67. The non-working removable head 140 may be generally curved so as to also match and be substantially flush with the inside ridge 85 of the wheel or rim 20. As a result, the non-working removable head 140 and the removable head 25 may both be in contact with opposing sides of the wheel or rim 20. Preferably, the device 1 crosses substantially through the center of the wheel or rim 20 such that the wheel or rim 20 is divided in half.

The non-working removable head 140 may have a first layer 26 and a second layer 27. The first layer 26 and the second layer 27 may be staggered so that, for example, the first layer 26 extends beyond the second layer 27. An edge 30 of the first layer 26 and the edge 31 of the second layer 27 may be generally curved so as to, for example, fit the curved surface of the inner ridge 85 of the wheel or rim 20. Because the side (and therefore the curvature) of the wheel or rim 20 may vary a good deal, the removable head 25 and/or the non-working removable head 140 may be interchangeable from the device 1 so as to match the curvature of the wheel or rim 20 or varying size.

A nut 70 (FIG. 1) may be located on the first shaft 2. When the first shaft 2 is inserted into the second shaft 3, the nut 70 may be tightened such that the device 1 is locked into a set position. In practice, the user first heats the dented or damaged portion of the wheel or rim 20 and then places the removable head 25 over the dented or damaged area of the wheel or rim 20. The user then extends the first shaft 2 slightly outward from the second shaft 3 by tightening the nut 70 on the first shaft 2. As a result, pressure is created in forcing the first shaft outward 2 from the second shaft 3 and this force is transferred to the damaged or dented portion of the wheel or rim 20. With the heat and the pressure, the damaged or dented portion of the wheel or rim 20 may be forced into the correct position by the pressure exerted by the removable head 25.

Figure 9B:
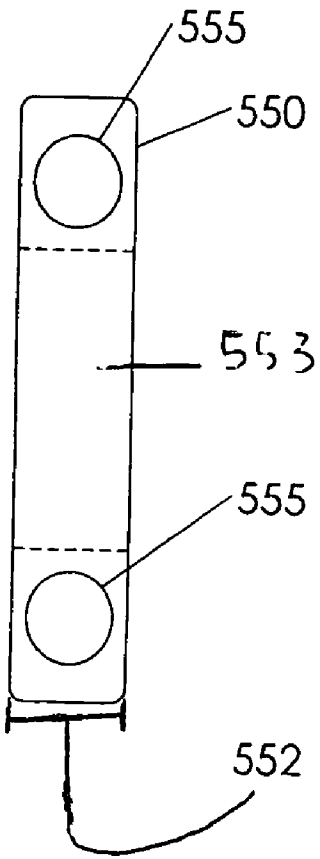
FIGS. 9*a* and 9*b* illustrate the ball bearing ring of the device.
Figure 9A:
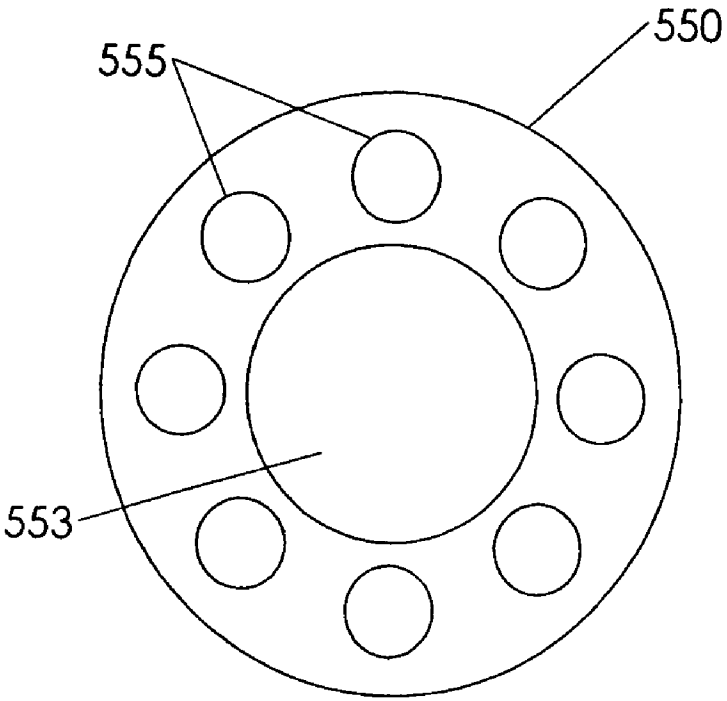

Located between the second end 14 of the second shaft 3 and the nut 70 may be, for example, a ring 550. The ring 550 may be generally circular and may have a width 552 and an opening 553 (FIG. 9). Located within an interior of the ring 550 may be, for example, ball bearings 555 which allow the ring 550 to rotate with respect to the first shaft 2 and the second shaft 3. As a result, the ring 550 may allow the rotation of the first shaft 2 within and with to respect to the second shaft 3 under the high pressure the device 1 is subjected to during the fixing of the wheel or rim 20.

A securing bar 100 (FIGS. 10*a* and 10*b*) may be removable and may be attached to, for example, the second shaft 3. The securing bar 100 may extend substantially perpendicular to the second shaft 3 while in use. The securing bar 100 may rest on the wheel or rim 20 (as shown in the figures) during use of the device 1. The securing bar 100 may help to stabilize the device 1 during use and may prevent the device 1 from inadvertently shifting under the pressure created during use.

In an embodiment, a securing bar 100 may have a first end 101 and a second end 102. The first end 101 of the securing bar 100 may have a secured hook 105. In an embodiment, the secured hook 105 may be screwed into the first end 101 of the securing bar 100 by, for example, threads located on the secured hook 105 and within an interior portion 110 of the securing bar 100. The securing bar 100 may also have a second hook 356 which may be located approximately mid way between the first end 101 and the second end 102 of the securing bar 100. A handle 338 may be secured to the second end 102 of the securing bar 100. The handle 338 may control the movement of the second hook 356 along the axis of the securing bar 100 such that when the handle 338 is rotated, the distance between the second hook 356 and the secured hook 105 may be altered depending on the size of the wheel or rim 20. More specifically, the second hook 356 may have threads which correspond to threads located on the exterior surface of the securing bar 100. As a result, the user may rotate the handle 338 and move the second hook 356 up or down the exterior surface of the securing bar 100.

The securing bar 100 may be an important, if not required, safety device. The securing device 100 may prevent slippage of the device 1 from the wheel or rim 20 during use and may therefore prevent, for example, injury to the user or damage to property.

Figure 10C:
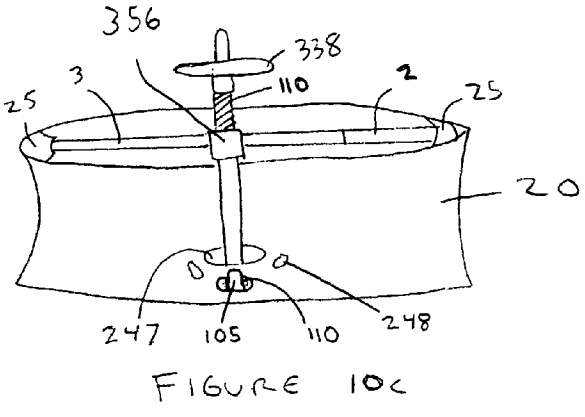
FIG. 10*c* illustrates the securing bar attached to the wheel.
Figure 10A:
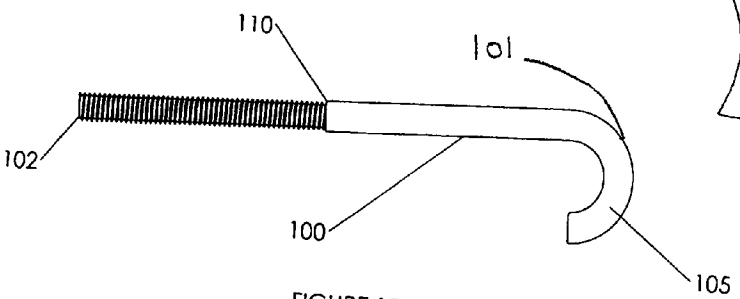
FIGS. 10*a* and 10*b* illustrate the securing bar of the device.
Figure 10B:
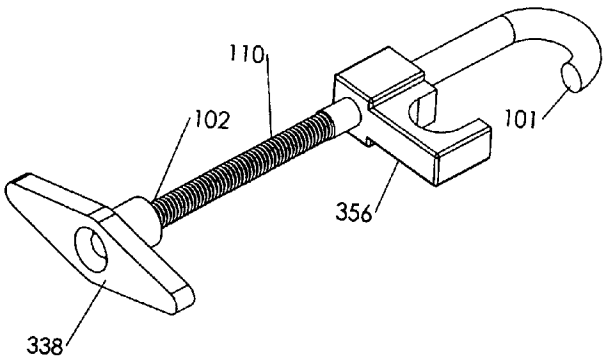
Figure 11:
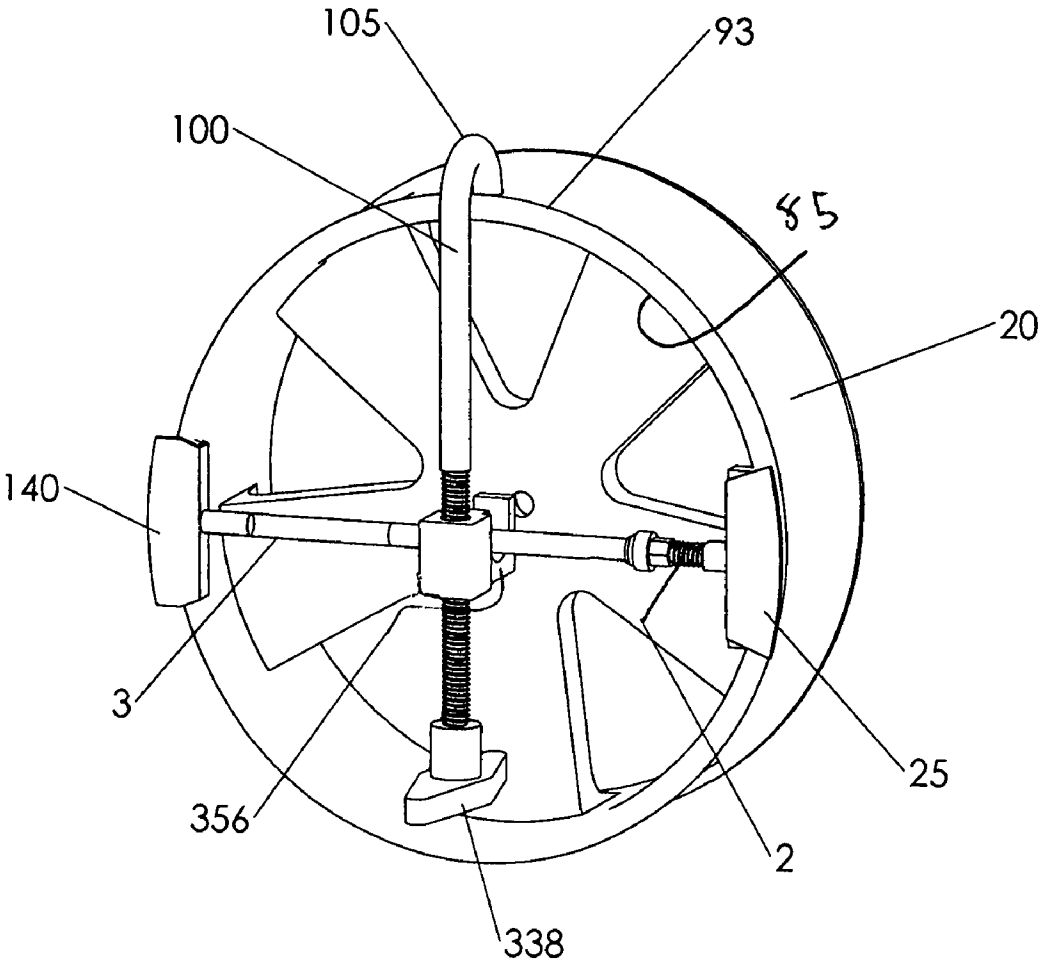
FIG. 11 illustrates the device inserted on the rim wherein the securing bar is attached.

Referring now to FIG. 10*c*, the securing bar 100 may alternatively be used vertically. More specifically, the device 1 may be placed along the diameter (and over the dented portion) of the wheel or rim 20 while the securing bar 100 is placed between the front and the back of the wheel or rim 20. Located near the center of the wheel or rim 20 may be a plurality of holes 248. During driving of the vehicle, the plurality of holes 248 may be placed over bolts permanently attached to an axle of the vehicle. Nuts may then secure the wheel or rim 20 to the vehicle by locking the wheel or rim 20 between the bolts of the vehicle and the nuts. Located in the dead center of the wheel or rim 20 may be a single large opening 247. The single large opening 247 may be located at the center of the plurality of holes 248.

In use, if the wheel or rim 20 is removed from the vehicle, the user may place the secured hook 105 of the first end 101 of the securing bar 100 through the single large opening 247 and then through one of the plurality of holes 248 of the wheel or rim 20. Therefore, the hook portion of the securing bar 100 may hook around a portion of the wheel or rim 20 which separates the plurality of holes 248 and the single large opening 247. The second hook 356 may then be secured around a portion of the device 1 (located near the center of the device 1) and tightened. As a result, the device 1 may be locked into place from the pressure created between the second hook 356 of the securing bar 100 and the secured hook 105 at the opposite end of the securing bar 100. The process is reversed to remove the securing bar 100 and the device 1 after the work has been preformed.

In practice, the user secures the appropriately sized removable head 25 and non-working removable head 140 on the device 1 to match the size of the wheel or rim 20. The dented portion of the wheel or rim 20 is heated to a temperature sufficient to allow the wheel or rim 20 to bend back to its original shape under the pressure created by tightening the device 1. The user then rotates the nut 70 until a fair amount of tension and pressure exists between the device 1 and the wheel or rim 20. The user then places the secured hook 105 around the outer rim surface 93 of the wheel or rim 20 and the second hook 356 of the securing bar 100 within an opening 417 located on the wheel or rim 20 or around the device 1 (as described below). Alternatively, the user may place the secured hook 105 and the second hook 356 around any portion of the wheel or rim 20 so as to apply tension and pressure to the device 1 and the wheel or rim 20.

As stated above, in an embodiment, the user may place the second hook 356 of the securing bar 100 over the exterior surface 6 of the second shaft 3. The user then tightens the securing bar 100 onto the device 1 such that movement of the device 1 is almost impossible under normal conditions (except that the device 1 may be extended or contracted telescopically). The pressure created by the securing bar 100 runs substantially perpendicular to the direction of the device 1 and helps reduce the chances of the device 1 shifting during repair of the wheel or rim 20.

The user then adjusts the device 1 telescopically (by expanding or contracting the length 27 of the device 1) while heating the wheel or rim 20 until the damaged or dented wheel or rim 20 is repaired. When fixed, both the securing bar 100 and the remaining device 1 is removed and the wheel or rim 20 is returned to the vehicle.

Figure 3:
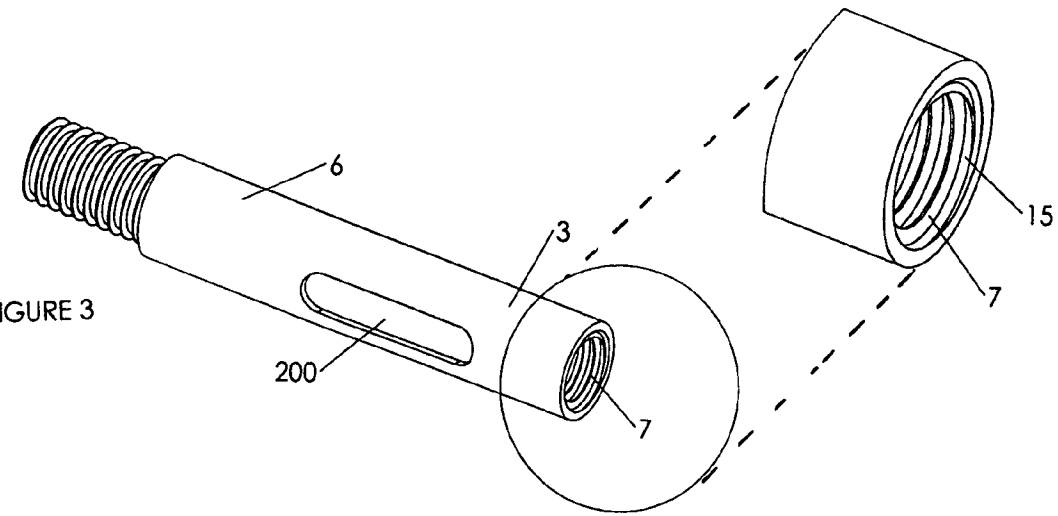
FIG. 3 illustrates a side perspective view of a shaft of the device.
Figure 12A:
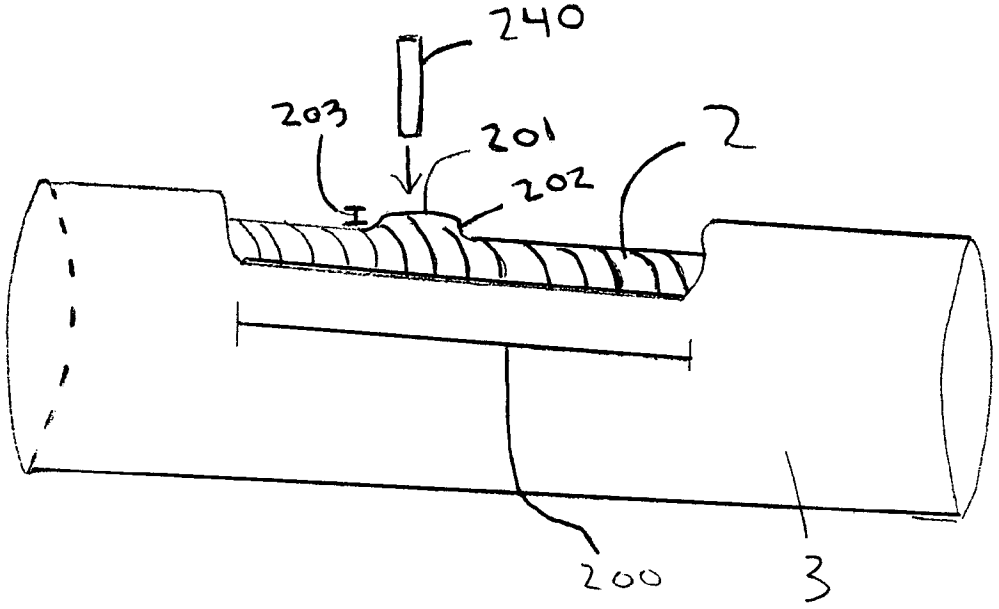
FIGS. 12*a* and 12*b* illustrate the opening along the second shaft.
Figure 12B:
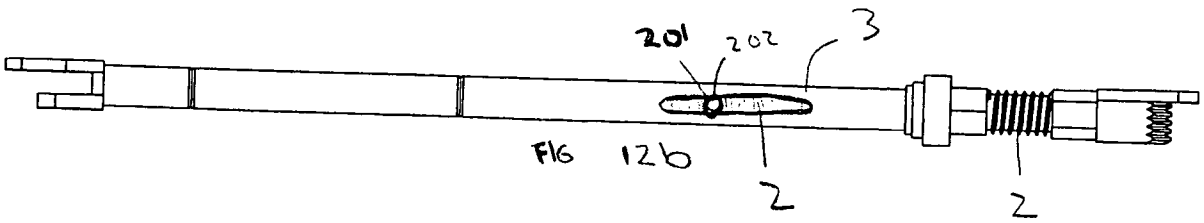

Referring now to FIG. 12, a generally rectangular opening 200 may be located on the second shaft 3. More specifically, the generally rectangular opening 200 may, for example, run substantially parallel to the length of the second shaft 3. Although the length of the generally rectangular opening 200 of the second shaft 3 may vary, FIG. 12 shows the generally rectangular opening 200 extending approximately a third of the length of the second shaft 3. This restriction on the size stabilizes the device 1 (as is discussed below). The generally rectangular opening 200 may extend from the exterior surface 6 of the second shaft 3 to the interior 7 (FIG. 3) of the second shaft 3.

The first shaft 2 may have an opening 201 extending largely perpendicular to the first shaft 2. The opening 201 may be largely circular and may be surrounded by an elevated lip portion 202. The opening 201 in the first shaft 2 may extend toward the interior of the first shaft 2. The elevated lip portion 202 of the opening 201 may have a to height 203 which may extend outward from the first shaft 2. The height 203 of the elevated lip portion 202 may be small enough so as to not restrict the insertion of the first shaft 2 into or out of the second shaft 3. The elevated lip portion 202 may add surface area to help secure a pin 240 (as described below) within the opening 201. In an embodiment, there is no elevated lip portion 202 and the opening 201 is flush on the first shaft 2.

In an embodiment, the pin 240 is inserted into the opening 201 after the first shaft 2 is inserted into the second shaft 3. When the pin 240 is inserted into the opening 201, the movement of the first shaft 2 within the second shaft 3 is limited to movement of the pin 240 within the generally rectangular opening 200 of the second shaft 3. The restriction of the first shaft 2 within the second shaft 3 prohibits the overall length of the combined first shaft 2 and second shaft 3 from becoming too large such that pressure applied to the device 1 causes the device 1 to break at, for example, the points of contact of the two shafts. Once the first shaft 2 is located within the second shaft 3 and positioned such that a portion of the first shaft 2 is adjusted at a predetermined position within the rectangular opening 200 of the second shaft 3 to match the size of the wheel or rim 20 being repaired, the user may insert a pin 240 into the opening 201 of the first shaft 2 to secure the first shaft 2 with respect to the second shaft 3. In addition, the user may secure a nut 70 (as disclosed below) to further prevent movement of the first shaft 2 with respect to the second shaft 3.

Figure 13:
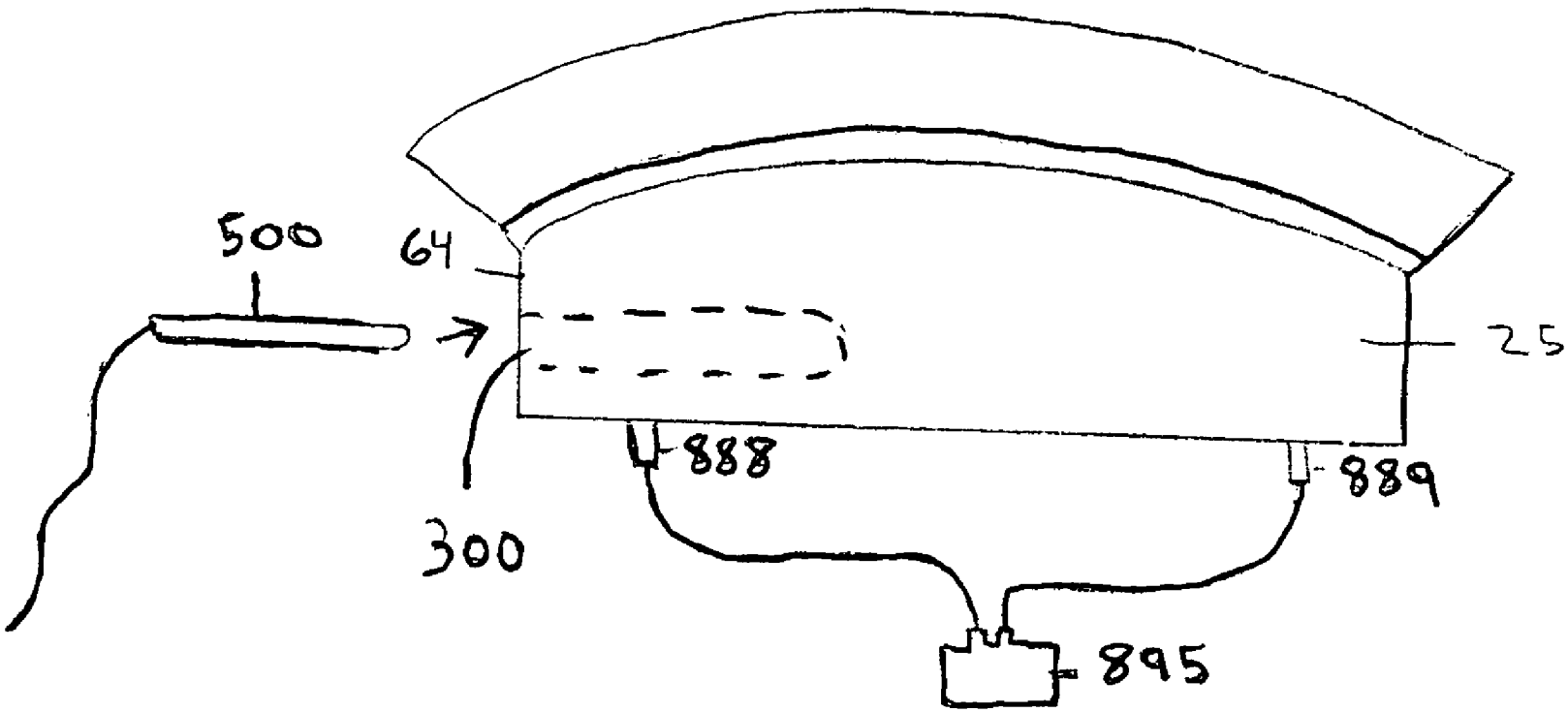
FIG. 13 illustrates the opening within the interior of the removable head of the device.
Figure 14B:
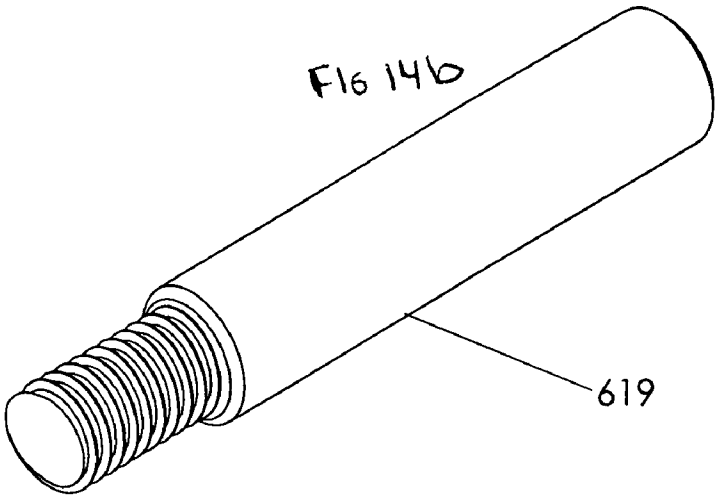
FIGS. 14*a* and 14*b* illustrate an extension unit for the second shaft.
Figure 14A:
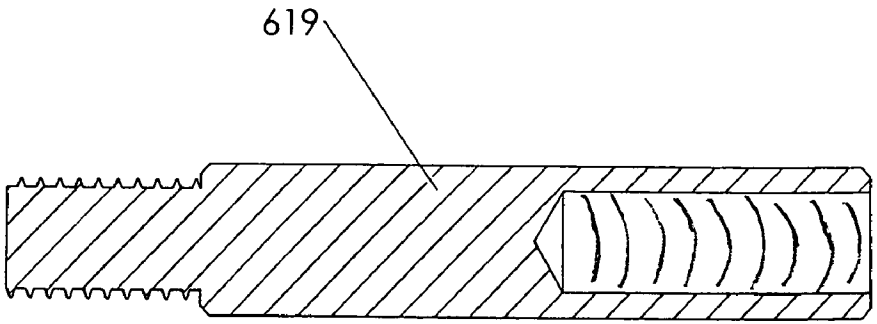
Figure 15:
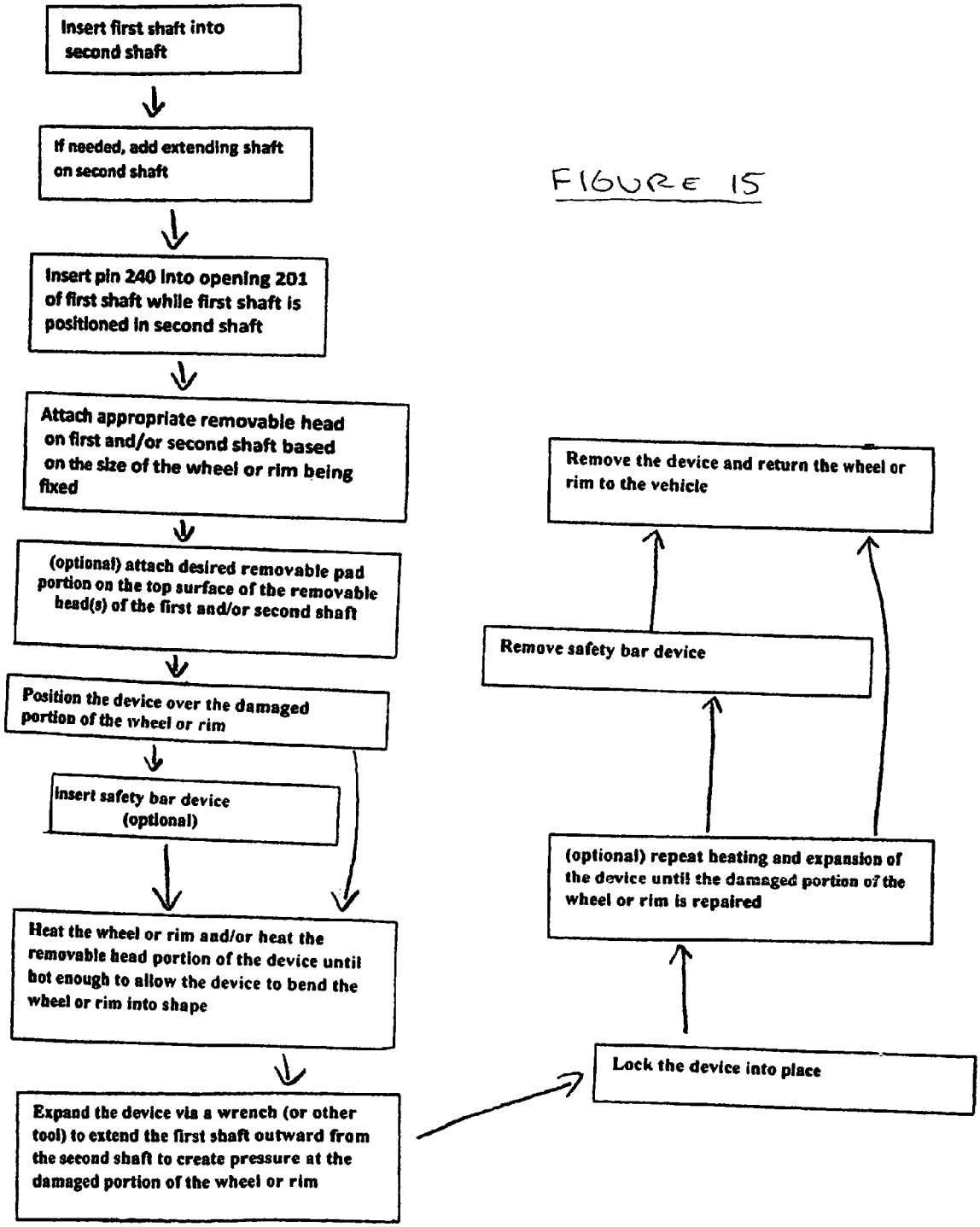
FIG. 15 illustrates a flow chart of the method of using the device.

Referring now to FIG. 13, in an embodiment, an opening 300 may be located on the removable head 25 of the device 1. More specifically, the opening 300 may be located on, for example, the first side of the removable head 25. The opening 300 may be generally circular and may extend inward toward the center of the removable head 25 in a generally cylindrical manner. In an alternative method to heating the wheel or rim 20 (as discussed below), the user may heat the interior of the interior cylindrical opening 300 of the removable head 25. The user may accomplish this by, for example, inserting an electrical device 500 (as seen in FIG. 13) into the opening or, for example, directly heating the removable head 25 by a flame via the interior opening 300. As a result, the user may not be required to apply heat directly to the wheel or rim 20. This may reduce possible structural and/or cosmetic damage to the wheel or rim 20.

In still another embodiment and method of use, the device 1 may have a positive terminal 888 (FIG. 13) and a negative terminal 889 (FIG. 13) located on, for example, the bottom of the removable head 25. Electrical wires may connect a battery 895 or other power source 895 to the positive terminal 888 and the negative terminal 889 such that electricity runs through at least the removable head 25 and heats the removable head 25 for proper use to fix a wheel or rim 20.

An extension device 619 may be connected to the second shaft 3 so that the total length 27 of the device 1 may be extended to accommodate, for example, wheels or rims 20 of trucks or other large vehicles. The extension device 619 has threads and grooves which correspond with the second shaft 2 and the non-working removable head 140.

Although the device 1 may not be able to fix all wheels or rims 20, the device 1 is suitable for fixing a wide variety of wheels or rims 20. The device 1 generally cannot be used to fix cracked or split wheels or rims 20. If the wheel or rim 20 is suitable for repair, the user may first check to see if the tire holds pressure. Next, the user may place, for example, soap solution around the damaged area to check for leaks. With the tire removed, the user may roll the wheel or rim 20 along the floor while checking with a straight edge or may use a balancer to check if the wheel or rim 20 is balanced. If the wheel or rim 20 has more than a very minor wobble, the wheel or rim 20 may not be repairable.

With the tire removed from the wheel or rim 20, the user may select the appropriate sized removable head 25 and may adjust the total length of the device 1 by rotating the nut 70 along the device 1 to either increase or decrease the amount of the first shaft 2 within the second shaft 3. Using, for example, a 400 Deg F. heat crayon 700, the user may mark the damaged area of the wheel or the rim 20. The user may then heat this area with, for example, a heat gun or torch until the crayon melts. The heat source may then be removed. The user may then extend the device 1 by rotating the nut 70 along the axis of the first shaft 2. As a result, the removable head 25 will be moved outward and into contact with the damaged area of the wheel or rim 20. Pressure, by means of a wrench, may be used on the body of the second shaft 3 to stabilize the device 1 while a second wrench is used to tighten the nut 70.

Once both ends of the device 1 is secured on the wheel or rim 20 and the securing bar 100 is secured, the heat and the pressure from tightening the device 1 further will repair the damaged surface of the wheel or rim 20.

After the damaged surface of the wheel or rim 20 is repaired, the user may sand and/or polish the wheel or rim 20. If an indentation remains, the user may fill in the indentation with, for example, molten aluminum. A second sanding and/or polishing may then be conducted. Once finally repaired, a tire may be placed back on the wheel or rim 20 and the entire tire balanced. Finally, the balanced tire may be returned to the vehicle.

In an embodiment, the first shaft 2 may move with respect to the second shaft 3 by, for example, air pressure. In this embodiment, pressurized air may be forced into the interior 7 of the second shaft 3 through an opening port (not shown). As air pressure increase, the second shaft 3 is expanded outward from the first shaft 2. As a result, the entire length of the device 1 is increased. As the total length increases, the removable head 25 and the non-working removable head 140 expand outward until contacting the wheel or rim 20. Once secured in place, work may be performed to fix the wheel or rim 20.

In an embodiment, two removable heads 25 may be used. More specifically, in this embodiment, there is no non-working removable head 140 but a working removable head 25 attached to the first shaft 2 and a second removable head 25 attached to the second shaft 3. The two removable heads 25 may be identical.

Although embodiments of the present invention are shown and described therein, it should be understood that various changes and modifications to the presently preferred embodiments will be apparent to those skilled in the art. Such changes and modifications may be made without departing from the spirit and scope of the present invention and without diminishing its attendant advantages. It is, therefore, intended that such changes and modifications be covered by the appended claims.

We claim:

1. A device for fixing a wheel or rim comprising: a first elongated shaft having a first end and a second end and wherein the first elongated shaft is perpendicularly attached at the first end to a first head; a second elongated shaft having a first end and a second end and a largely hollow interior and wherein the second elongated shaft is perpendicularly attached to a second head and wherein at, least a portion of the first elongated shaft telescopically moves within the largely hollow interior of the second elongated shaft; and a curved surface on the first head wherein the curved surface has an arc similar to an arc of a wheel or rim of a vehicle and a curved surface on the second head wherein the curved surface has an arc substantially similar to an arc of a wheel or rim; and wherein a length between distal ends of the curved surface of the first head and curved surface of the second head are substantially identical to a diameter of an interior surface of the wheel or rim; and an elongated opening on the second elongated shaft wherein the elongated opening extends inward into the interior of the second elongated shaft and exposes a port located on the first elongated shaft and wherein a pin inserted through the elongated opening on the second elongated shaft and into the port of the first elongated shaft locks the first elongated shaft in place with respect to the second elongated shaft and prevents movement of the first elongated shaft with respect to the second elongated shaft.

2. A device for fixing a wheel or rim comprising: a first elongated shaft having a first end and a second end and wherein the first elongated shaft is perpendicularly attached at the first end to a first head; a second elongated shaft having a first end and a second end and a largely hollow interior and wherein the second elongated shaft is perpendicularly attached to a second head and wherein at, least a portion of the first elongated shaft telescopically moves within the largely hollow interior of the second elongated shaft; and a curved surface on the first head wherein the curved surface has an arc similar to an arc of a wheel or rim of a vehicle and a curved surface on the second head wherein the curved surface has an arc substantially similar to an arc of a wheel or rim; and wherein a length between distal ends of the curved surface of the first head and curved surface of the second head are substantially identical to a diameter of an interior surface of the wheel or rim; and a first back located on the first head wherein the back curves with a top surface of the first head and wherein the first back extends perpendicularly with respect to the top surface of the first head and wherein the first back extends at least partly outside of an interior diameter of the wheel or rim and wherein the first back braces and secures the device within the interior diameter of the wheel or rim.

3. A device for fixing a wheel or rim comprising: a first elongated shaft having a first end and a second end and wherein the first elongated shaft is perpendicularly attached at the first end to a first head; a second elongated shaft having a first end and a second end and a largely hollow interior and wherein the second elongated shaft is perpendicularly attached to a second head and wherein at least a portion of the first elongated shaft telescopically moves within the largely hollow interior of the second elongated shaft; and a curved surface on the first head wherein the curved surface has an arc similar to an arc of a wheel or rim of a vehicle and a curved surface on the second head wherein the curved surface has an arc substantially similar to an arc of a wheel or rim; and a positive terminal and a negative terminal attached to the first head wherein the terminals are connected to a power source via a wire and wherein a flow of electricity passes from the positive terminal to the negative terminal and therein causes the first head to heat up via electricity to a temperature sufficient to allow a mending of the wheel or rim via the device.

4. A device for fixing a wheel or rim comprising: a first elongated shaft having a first end and a second end and wherein the first elongated shaft is perpendicularly attached at the first end to a first head; a second elongated shaft having a first end and a second end and a largely hollow interior and wherein the second elongated shaft is perpendicularly attached to a second head and wherein at, least a portion of the first elongated shaft telescopically moves within the largely hollow interior of the second elongated shaft; and a curved surface on the first head wherein the curved surface has an arc similar to an arc of a wheel or rim of a vehicle and a curved surface on the second head wherein the curved surface has an arc substantially similar to an arc of a wheel or rim; and wherein a length between distal ends of the curved surface of the first head and curved surface of the second head are substantially identical to a diameter of an interior surface of the wheel or rim; and an opening extending into an interior of the first head wherein the opening receives a heating device and wherein heat is transferred from the heating device to the first head to a temperature sufficient to allow a mending of the wheel or rim via the device.

5. A device for fixing a wheel or rim comprising: a first elongated shaft having a first end and a second end and wherein the first elongated shaft is perpendicularly attached at the first end to a first head; a second elongated shaft having a first end and a second end and a largely hollow interior and wherein the second elongated shaft is perpendicularly attached to a second head and wherein at, least a portion of the first elongated shaft telescopically moves within the largely hollow interior of the second elongated shaft; and a curved surface on the first head wherein the curved surface has an arc similar to an arc of a wheel or rim of a vehicle and a curved surface on the second head wherein the curved surface has an arc substantially similar to an arc of a wheel or rim; and wherein a length between distal ends of the curved surface of the first head and curved surface of the second head are substantially identical to a diameter of an interior surface of the wheel or rim; and a third shaft having a first end and a second end and a partly hollow interior wherein the partly hollow interior receives a portion of the first or second shaft and wherein the third shaft allows a total length of the device to be extended to accommodate wheels or rims with larger diameters.

6. A device for fixing a wheel or rim comprising: a first elongated shaft having a first end and a second end and wherein the first elongated shaft is perpendicularly attached at the first end to a first head; a second elongated shaft having a first end and a second end and a largely hollow interior and wherein the second elongated shaft is perpendicularly attached to a second head and wherein at, least a portion of the first elongated shaft telescopically moves within the largely hollow interior of the second elongated shaft; and a curved surface on the first head wherein the curved surface has an arc similar to an arc of a wheel or rim of a vehicle and a curved surface on the second head wherein the curved surface has an arc substantially similar to an arc of a wheel or rim; and wherein a length between distal ends of the curved surface of the first head and curved surface of the second head are substantially identical to a diameter of an interior surface of the wheel or rim wherein the second head is permanently secured to the second elongated shaft and wherein a non-identical first head is removable secured to the first elongated shaft.

7. A device for fixing a wheel or rim comprising: a first elongated shaft having a first end and a second end and wherein the first elongated shaft is perpendicularly attached at the first end to a first head; a second elongated shaft having a first end and a second end and a largely hollow interior and wherein the second elongated shaft is perpendicularly attached to a second head and wherein at, least a portion of the first elongated shaft telescopically moves within the largely hollow interior of the second elongated shaft; and a curved surface on the first head wherein the curved surface has an arc similar to an arc of a wheel or rim of a vehicle and a curved surface on the second head wherein the curved surface has an arc substantially similar to an arc of a wheel or rim; and wherein a length between distal ends of the curved surface of the first head and curved surface of the second head are substantially identical to a diameter of an interior surface of the wheel or rim; and a second back located on the first head wherein the second back curves with a top surface of the first head and wherein the second back extends perpendicularly with respect to the top surface of the first head and wherein the second back is parallel to the first back and wherein the first and second back are separated by the top surface of the first head.

8. A method for fixing a wheel or rim of a vehicle comprising the steps of: providing a device having a first elongated shaft having a first end and a second end and wherein the first elongated shaft is perpendicularly attached at the first end to a first head; providing a second elongated shaft having a first end and a second end and a largely hollow interior and wherein the second elongated shaft is attached to a second head and wherein at least a portion of the first elongated shaft telescopically moves within the largely hollow interior of the second elongated shaft; providing a curved surface on the first head wherein the curved surface has an arc similar to an arc of a wheel or rim of a vehicle and a curved surface on the second head wherein the curved surface has an arc substantially similar to an arc of a wheel or rim; and wherein a length between distal ends of the curved surface of the first head and curved surface of the second head are substantially identical to a diameter of an interior surface of the wheel or rim; placing the device within a wheel or rim such that the device extends along and covers a portion of a diameter of the wheel or rim; aligning the device such that the first head and/or second head are in contact with and at least partly cover a dented or otherwise damaged area of the wheel or rim; providing a heat source to the damaged area portion of the wheel or rim; extending a length of the device by telescopically extending a portion of the first elongated shaft farther outside of the hollow interior of the second elongated shaft wherein pressure is applied to the heated wheel or rim; and removing the device from the wheel or rim after a dented wheel or rim is fixed; and attaching electrical wires to the first or second head; and providing an electrical current through the electrical wires and first or second head to heat the first or second head.

* * * * *